United States Patent [19]

Smith et al.

[11] Patent Number: 5,075,986

[45] Date of Patent: Dec. 31, 1991

[54] ATTACHMENT ASSEMBLY FOR EXCAVATION TEETH

[75] Inventors: Harry Smith, Benicia, Calif.; Chuck Clendenning, Broken Arrow; Paul Millspaugh, Tulsa, both of Okla.

[73] Assignee: H & L Tooth Company, Montebello, Calif.

[21] Appl. No.: 652,935

[22] Filed: Feb. 8, 1991

[51] Int. Cl.[5] ..... E02F 9/28

[52] U.S. Cl. ..... 37/142 A; 37/142 R

[58] Field of Search ..... 37/141 R, 141 T, 142 R, 37/142 A

[56] References Cited

U.S. PATENT DOCUMENTS

| | | | |
|---|---|---|---|
| 4,282,665 | 8/1981 | Fletcher et al. | 37/142 A |
| 4,324,057 | 4/1982 | White | 37/142 A |
| 4,516,340 | 5/1985 | Launder | 37/142 A |
| 4,727,663 | 3/1988 | Hahn | 37/142 A |
| 4,848,013 | 7/1989 | Bowman et al. | 37/142 A |
| 4,872,274 | 10/1989 | Giersch et al. | 37/142 A X |

*Primary Examiner*—Dennis L. Taylor
*Assistant Examiner*—J. Russell McBee
*Attorney, Agent, or Firm*—Lyon & Lyon

[57] ABSTRACT

An attachment assembly for securing large excavation teeth on large earth excavation equipment including an excavation tooth, an adaptor having a tapered nose piece at one end thereof for carrying the tooth and defining means rearwardly of the nose piece for securing the adaptor to the excavation implement, a pin for securing the tooth in place on the nose piece and a wear cap adapted to be carried by an engage the adaptor so as to abut a rear portion of the tooth for reducing wear of the adaptor during use. The wear cap defines a forward tooth abutment surface, a first inclined lower surface adapted to abut a first portion of the adaptor rearwardly of the nose piece, a second inclined lower surface spaced from the first inclined lower surface and adapted to abut a second portion of the adaptor and an opened channel disposed between the first and second inclined surfaces and extending transversely through the wear cap. The channel defines a continuously curvilinear transverse inner wall within the wear cap and is adapted to receive a correspondingly configured transversed rib formed on the adaptor such that upon transversely sliding of the wear cap over the rib, the first and second lower inclined surfaces abut the first and second portions of the adaptor and the forward tooth abutment surface of the wear cap is disposed substantially normal to the tooth. The tooth abutment surface defines a pair of locking projections thereon which are received in a pair of similarly configured channels formed in the base of the excavation tooth to interlock the tooth and wear cap and prevent relative lateral movement therebetween.

11 Claims, 3 Drawing Sheets

ATTACHMENT ASSEMBLY FOR EXCAVATION TEETH

BACKGROUND OF THE INVENTION

This invention relates to an attachment assembly for the connection of large excavation teeth to the shovel or dipper bucket of large excavation equipment. More particularly, this invention relates to a novel protective wear cap for use in an attachment assembly which employs an adaptor and a securement pin for securing a large excavation tooth to the excavating equipment for the purpose of reducing the wear on the adaptor during use and thereby significantly decrease the costs associated with part replacement.

During the course of large ground excavation projects, it has been found that it is preferable to make the excavation teeth a separate and distinct part, readily attachable and detachable to the main excavation implement, rather than forming the excavation teeth integrally with the main implement. This allows for easy replacement of individual teeth should a tooth become broken or dulled through wear.

Traditionally, the excavation tooth has a hollow interior portion which fits onto a forwardly projecting nose piece on an adaptor secured to the shovel or dipper bucket of the excavation equipment. Pin means are thrust through an orifice in the excavation tooth and through a channel in the nose piece to retain the tooth in position on the nose piece. Because of the tremendous pressure which is exerted upon the tooth during excavation, it is desirable to displace the pin transversely to the excavation movement, which is normally and primarily in the vertical direction. Parallel placement of the pin allows the pin to wobble under the force generated by the excavation implement. This wobble causes early failure of the pin causing the tooth to drop off.

For many years, a simple arrangement involving a single horizontally displaced pin was sufficient. Subsequently, however, the excavation implements began utilizing closely spaced teeth, thereby making it difficult, and in some instances impossible, to displace the traditional horizontal pin within the excavation tooth. Therefore, there existed a need in the art for a locking assembly whereby the excavation tooth may be engaged and disengaged by working vertically.

Another problem historically encountered with devices of this type stems from the fact that the nose piece of the adaptor can become worn so that there is not a precise fit between the tooth and nose piece. This allows for some horizontal movement of the tooth on the nose piece as well as some vertical or rotational movement of the tooth with respect to the nose piece. A solution to these problems is found in U.S. Pat. No. 4,516,340 which discloses an attachment assembly including a nose piece projecting from an adaptor, an excavation tooth and a single vertically mounted securement pin, wherein the nose piece defines a tapered extension for carrying the excavation tooth. The tapered extension defines a recessed horizontal stabilizing surface at the extended end thereof which is bordered by a vertical stabilizing wall. The tooth has a channel therein corresponding to the configuration of the tapered extension of the nose piece so that the nose piece can fit snugly thereover in a mating relationship and the securement pin extends vertically through the tapered extension of the nose piece and the excavation tooth securing the tooth in place on the nose piece. The mating relationship of the channel walls in the excavation tooth with the recessed horizontal stabilizing surface and vertical stabilizing walls prevent lateral and vertical, or rotational movement of the tooth with respect to the nose piece to provide a secured and durable yet readily detachable excavation tooth assembly.

While such an attachment assembly provided improved securement of a large excavation tooth in a row of closely spaced teeth on large excavation equipment utilizing only a single vertical pin it has been found that, over a period of time, the adaptor became worn and must be replaced. The wear occurs because of the abrasion of the forward portion of the adaptor caused by the material passing thereon during use and by continual contact between the rearward end or base of the tooth and the portion of the adaptor rearwardly adjacent the nose piece and the great forces exerted on that portion of the adaptor by the tooth during use. While replacement of excavation teeth due to wear is a common and necessary occurrence, replacement of the adaptor is highly undesirable due to its significant size, weight and costs. It would therefore be very desirable to provide an attachment assembly which retains all of the advantages inherit in the attachment assembly disclosed in the aforesaid U.S. Pat. No. 4,516,340, but which reduces the wear on the adaptor, thereby substantially reducing the parts and labor costs associated with its replacement.

In an effort to retain the benefits of the aforesaid patented attachment assembly, protective wear caps were developed which were carried by the forward portion of the adaptor and positioned thereon so as both to shield the adaptor from the abrasion of the material passing thereover during use and to be abutted by a portion of the rearward end or base of the tooth and thus sustain the wear caused by frictional engagement with the tooth which was previously borne by the adaptor. When the wear cap became overly worn, it could then be replaced far more economically than the much larger and expensive adaptor. While such wear caps did prolong the life of the adaptor in many instances they tended to create additional durability problems which resulted from the manner in which they were configured and secured to the adaptor.

With the previously developed protective wear caps, the adaptor was provided with an integrally formed dove-tailed projection which extended axially and rearwardly from the nose piece and was axially received in a correspondingly configured channel in the underside of the wear cap. To manufacture such a configuration with the tolerances necessary to prevent binding of the mating adjacent surfaces in the attachment, it was necessary to machine the mating dove-tailed surfaces, which is quite expensive. In addition, the dove-tailed configuration defined acute angles in the mating parts which created stress risers on both the wear cap and adaptor which on occasion led to failure of either the wear cap or the adaptor.

Another problem with such protective wear caps was their tendency to slide down the nose piece during tooth replacement which made tooth replacement a more laborious and time consuming task. This resulted from the axial mounting of the wear cap on a tapered surface of the adaptor. The protective wear cap and mating adaptor configuration of the present invention enables the attachment assembly disclosed herein to retain the benefits of the attachment assembly disclosed in U.S. Pat. No. 4,516,340, as well as the benefit of using a protective wear cap to reduce adaptor wear, but obviates the need to machine the parts, eliminates creation of stress risers in either the wear cap or the adaptor, and additionally prevents the wear cap from inadvertently sliding off the adaptor during tooth replacement. As a result, the deficiencies of the previously employed protective wear caps have been eliminated without adversely affecting the attachment and securement means of the previously patented structure.

SUMMARY OF THE INVENTION

Briefly, the present invention is directed to an assembly for securing large excavating teeth on large earth excavation equipment in a manner such that the teeth which are closely spaced can be readily attached and removed for replacement, and during use, are resistant to lateral, vertical or pivotal movement with respect to the adaptor, while the adaptor is protected from wear resulting from material flowing over the top thereof during use and the continual abutting contact with the base of the excavation tooth. The assembly includes an adaptor having a nose piece projecting from one end thereof, an excavation tooth, a single securement pin, and a protective wear cap carried by the adaptor and positioned such that the base of the tooth member abuts the wear cap, not the adaptor.

The adaptor is provided with a transversely extending projection or rib disposed rearwardly of the nose piece which extends the full width of the adaptor and defines a continuous curved surface so as not to create any stress risers therein. This rib is adapted to be received in a correspondingly configured open ended transverse channel in the lower surface of the protective wear cap so that the wear cap can be slided transversely thereover onto the adaptor and held axially in place by the transverse rib to prevent inadvertent sliding of the wear cap forwardly down and off the adaptor. The continuous curvilinear surfaces defining the transverse rib on the adaptor and the mating channel in the wear cap not only prevent the formation of stress risers but allow the respective parts to be formed by flame cutting without the need for additional machining. The wear cap also defines a tooth abutment surface which, upon the wear cap being mounted on the adaptor, is normal to the base of the tooth and abuts a portion thereof so as to absorb the shock and wear which would otherwise be imparted to the adaptor. The abutment surface of the wear cap defines a pair of curvilinear vertical locking projections which are received in a pair of similarly configured channels formed in the base of the excavation tooth to prevent the wear cap from moving laterally with respect to the tooth and adaptor during use.

It is therefore the principal object of the present invention to provide a means for reducing the wear on the adaptor in an attachment assembly for securing an excavation tooth on large excavation equipment without adversely affecting the strength or securement of the components comprising the assembly.

It is another object of the present invention to provide an improved protective wear cap for use in an excavation tooth attachment assembly of the type employing an adaptor for carrying and securing the tooth to the excavation equipment which reduces the wear on the adaptor normally resulting from material flowing thereover and from excavation.

It is yet another object of the present invention to provide a protective wear cap for use in an attachment assembly for securing an excavation tooth to large excavation equipment which is secured such that it will not inadvertently slide off the assembly during tooth replacement.

It is a still further object of the present invention to provide a protective wear cap for use in an attachment assembly for securing an excavation tooth to large excavation equipment which is secured so as to prevent movement thereof relative to the tooth or other components of the assembly during use.

These and other objects and advantages of the present invention will become readily apparent from the following detailed description taken into conjunction with the accompanying drawings.

DESCRIPTION OF THE PREFERRED EMBODIMENT

IN THE DRAWINGS

Figure 1:
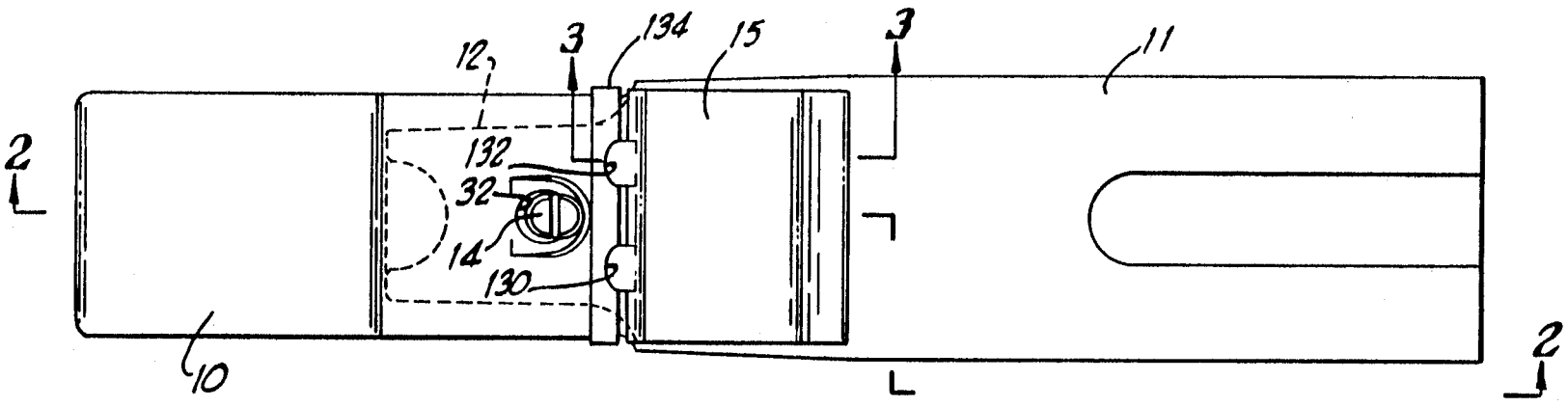
FIG. 1 is a plan view of the attachment assembly of the present invention.
Figure 2:
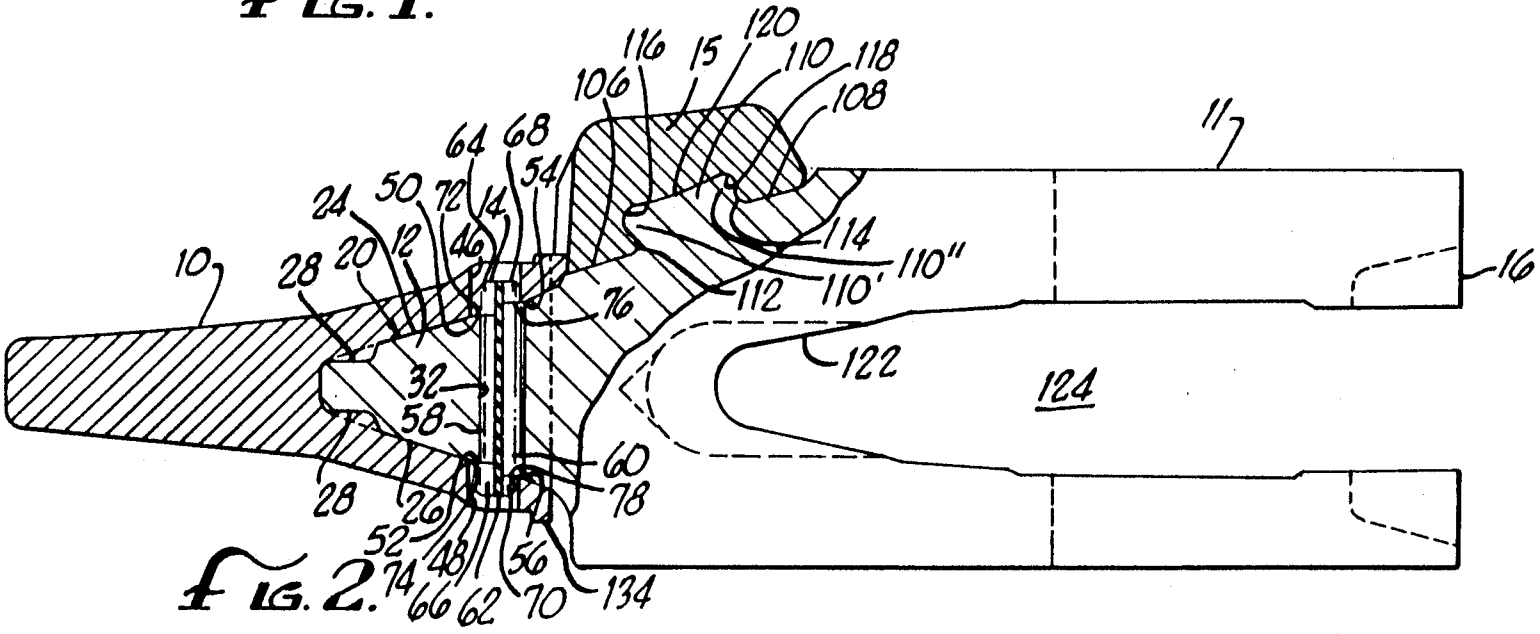
FIG. 2 is a sectional view taken along line 2-2 in FIG. 1.
Figure 5:
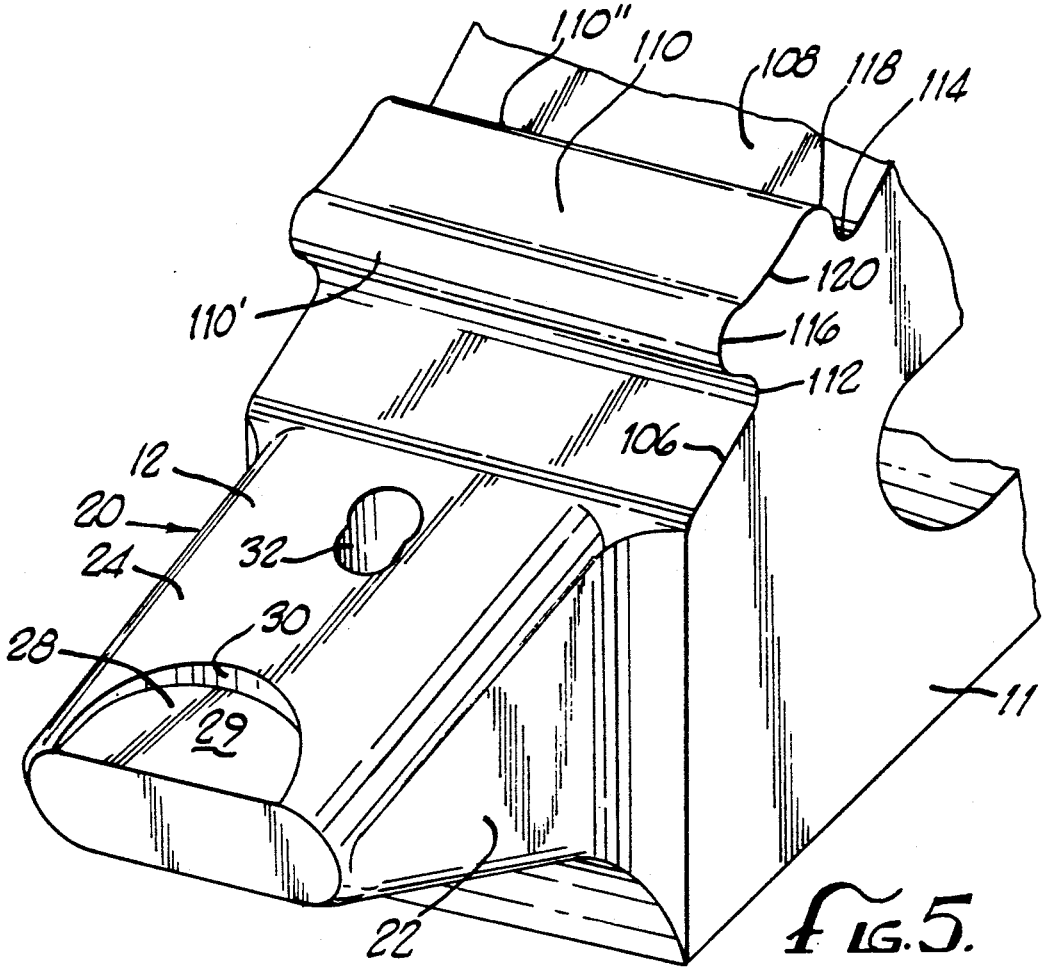
FIG. 5 is a perspective view of the tapered extension of the nose piece illustrating the vertical and horizontal tooth securement surfaces thereon.

Referring now in detail to the drawings, the assembly of the present invention comprises an excavation tooth 10, an adaptor 11 defining a nose piece 12 integrally formed therewith and projecting from the forward end thereof, a securement flex pin 14 and a protective wear cap 15. Adaptor 11 also defines a conventional base portion 16 which is adapted for conventional securement by a wedge locking mechanism to the shovel or dipper bucket of the earth excavation device (not shown). Nose piece 12 defines a tapered extension 20 which carries the excavation tooth 10 as seen in FIGS. 1 and 2. As seen in FIG. 5, tapered extension 20 defines a pair of slightly tapered lateral side walls 22 and tapered upper and lower surfaces 24 and 26. Surfaces 24 and 26 have recessed areas 28 cut therein at the extended ends thereof which define flat substantially horizontal stabilizing surfaces 29 bordered by curvilinear vertical stabilizing walls 30. Surfaces 29 are not truly horizontal, but tapered slightly to facilitate removal of the nose piece from the dye during fabrication. Accordingly, the surfaces 29 are referred to herein as substantially horizontal and are therefore substantially, but not exactly, parallel to one another. The terms horizontal and vertical as used herein refer to the orientation of the excavating implement upon the ground as shown in FIG. 1. The excavation movement of the implement would be primarily in the vertical direction. A substantially elliptical vertical channel 32 extends through the rearward portion of the tapered extension 20 of nose piece 12 for receipt of the securement flex pin 14 in a manner to be described. This channel can be formed by drilling two overlapping holes through the rear portion of extension 20 to provide the configuration illustrated in the drawings.

Figure 6:
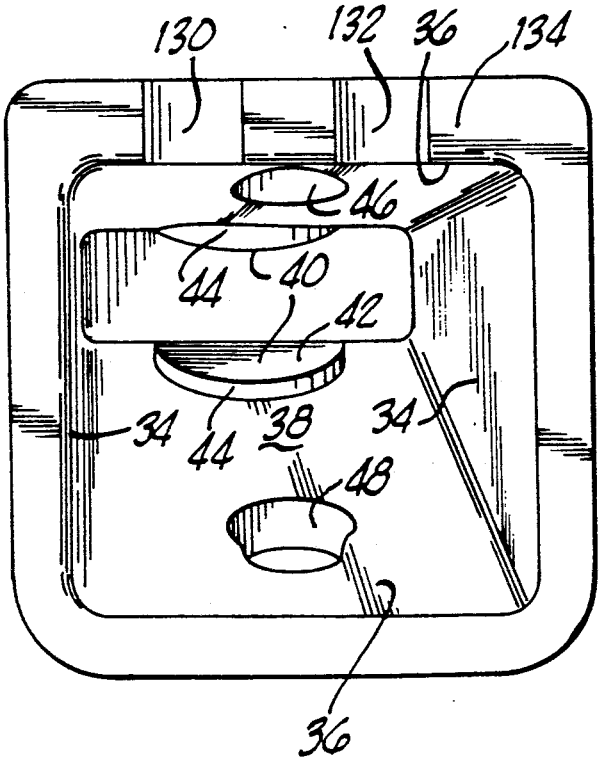
FIG. 6 is a perspective view of the tooth illustrating the interior thereof.

Tooth 10 has substantially parallel side walls 34, tapered upper and lower surfaces 36 and defines a cavity 38 therein which corresponds in configuration to the tapered extension 20 of the nose piece so that the tooth 10 can fit snugly thereover in a mating relationship. As seen in FIG. 6, protuberances 40 are integrally formed with the tooth 10 and extend into the cavity 38 from surfaces 36 and define inwardly projecting horizontal surfaces 42. Surfaces 42 are adapted to mate in an abutting relationship with the flat stabilizing surface 29 in the end of the nose piece 12 and the outer perimeter walls 44 of protuberances 40 abuts the vertical stabilizing walls 30. As seen in FIGS. 5 and 6, areas 28 and mating protuberances 40 are substantially semicircular to facilitate manufacture of the stabilizing surfaces 29 and walls 30 by drilling the areas 28 out of the forged steel tooth. If desired, other shapes could also be employed albeit at a greater cost of manufacture. If other configurations of the stabilizing surfaces were employed the protuberances would be shaped correspondingly to mate with the horizontal and vertical stabilizing surfaces defining the recessed area as above described.

Tooth 10 has elliptically-shaped orifices 46 and 48 extending through the rearward portion thereof bifurcated by cavity 38 and corresponding to the channel 32 in the nose piece 12. The major diameters of orifices 46 and 48 are slightly larger than the major diameter of elliptical channel 32 as seen in FIGS. 1 and 2 so as to substantially, but not totally register with vertical channel 32 when the tooth 10 is secured on the nose piece 12 such that a portion of the nose piece is exposed in orifices 46 and 48 to create shoulders 50 and 52 and a portion of the tooth 10 extends over channel 32 to create shoulders 54 and 56 (see FIG. 2).

The securement flex pin 14 is ellipsoidal in cross section having a first half or elongate member 58 and a second half or elongate member 60 joined in a conventional manner by a hard yet resilient rubber center 62. The width of flex pin 14 across the rubber center 62 is slightly larger than the corresponding dimension of channel 32 such that upon insertion of the flex pin 14 in channel 32 a degree of compression of rubber center 62 occurs. The elongate members 58 and 60 are preferably constructed of heat-treated alloy steel. The hard rubber center 62 is preferably constructed of 60 shore hard rubber. First elongate member 58 has a heel portion 64 and a beveled nose portion 66. The heel portion 64 presents a blunt surface to the hammer or other implement (not shown) used to drive the flex pin 14 through orifice 46 or 48 and into the vertical channel 32 in the nose piece. The second elongate member 60 of flex pin 14 has a heel portion 68 and a beveled nose portion 70.

The exterior diameter of first elongate member 58 is abruptly reduced below heel portion 64 and above nose portion 66 to create shoulders 72 and 74. The exterior diameter of the second elongate member 60 is abruptly increased below heel portion 68 and above nose portion 70 to create shoulders 76 and 78. The distance between shoulders 72 and 74 correspond to the minor diameter of vertical channel 32 at its point nearest the working end of tooth 10. This is best seen in FIG. 2. Therefore, when flex pin 14 is inserted through orifice 48 into vertical channel 32, the shoulders 72 and 74 will embrace nose piece 12 at either end of channel 32 thereby retaining flex pin 14 within the nose piece 12. Similarly, the distance between shoulders 76 and 78 corresponds to the distance between the interior edges of orifices 46 and 48 at a point most distant from the working end of tooth 10. This is also best seen in FIG. 2. Accordingly, when flex pin 14 is fully inserted into nose piece 12, shoulders 76 and 78 will abut against tooth 10 at the interior edge of orifices 46 and 48. This will also work to retain flex pin 14 within nose piece 12.

Figure 3:
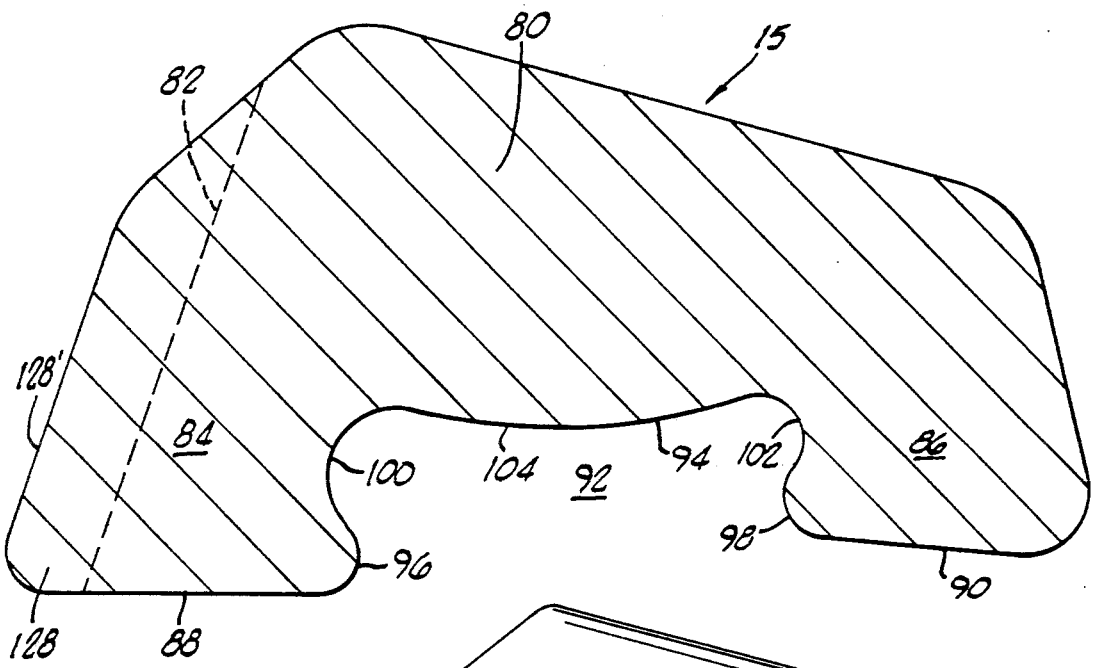
FIG. 3 is a sectional view taken along line 3-3 in FIG. 1.
Figure 4:
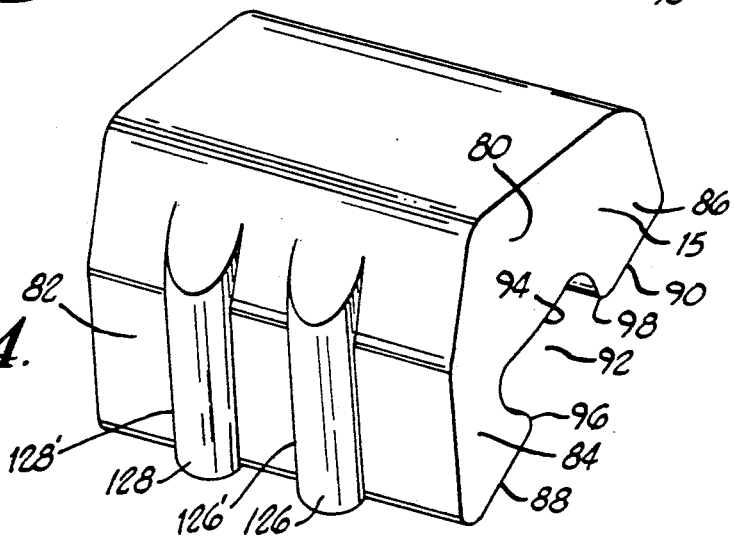
FIG. 4 is a perspective view of the wear cap of the present invention.

The protective wear cap 15 which is best seen in FIGS. 3 and 4, is constructed of hardened steel, is substantially equal in width to the width of adaptor 11, and defines a body portion 80, a forward tooth abutment surface 82, a pair of depending leg portions 84 and 86 terminating in lower inclined surfaces 88 and 90, and an open-ended channel 92 disposed between leg portions 84 and 86 and extending transversely through the underside of body portion 80. Channel 92 is open along its lower length and is defined by a continuously curvilinear inner wall 94 to prevent the formation of any stress risers in wear cap 15. Wall 94 extends between inclined lower surfaces 88 and 90 and defines a pair of lower rounded inwardly projecting shoulders 96 and 98 which blend into a pair of oppositely disposed rounded outwardly projecting shoulders 100 and 102, which in turn blend smoothly into a convex upper surface 104.

The upper surface of adaptor 11 rearwardly adjacent nose piece 12 defines a pair of inclined flat surfaces 106 and 108 and an inclined transverse securement rib 110 disposed therebetween which extends across the width of adaptor 11. Secuıement rib 110 is configured to be received within channel 92 in wear cap 15 such that the wear cap can be slided transversely thereover and held axially in place by securement rib 110. Securement rib 110 defines a pair of inwardly directed rounded shoulders 112 and 114 adapted to mate with shoulders 96 and 98 on wear cap 15, a pair of outwardly directed shoulders 116 and 118 adapted to mate with shoulders 100 and 102 on wear cap 15 and a concave upper surface 120 adapted to mate with the upper surface 104 of the wear cap. By so configuring a securement rib 110, the formation of stress risers therein is avoided and the wear cap 15, upon being slided thereover, can only be moved in a transverse direction parallel to rib 110, avoiding inadvertent displacement of the wear cap in any other direction.

To avoid weakening adaptor 11 by the formation of securement of rib 110 and to strengthen wear cap 15, the radii of curvature of the shoulders defined by wear cap 15 and securement rib 110 are sized such that the forward basing side 110' of rib 110 is thicker than the rearwardly facing side 110' thereof and the forward leg portion 84 of wear cap 15 is longer than rear leg portion 86, thereby strengthening those portions of the securement rib 110 and wear cap 15 against which the base of tooth 10 bears. In addition, the thickness of the base portion 16 of adaptor 11 between the inclined surface 108 thereon and the inner surface 122 of the dipper bucket attachment channel 124 is increased to avoid weakening the base 16 of the adaptor at its point of thinnest cross-section.

As seen in FIGS. 3 and 4, the forward vertical surface 82 of wear cap 15 is provided with a pair of substantially semicylindrical vertically extending stabilizing ribs 126 and 128 which are integrally formed with the wear cap 15 and are adapted to be received in semicircular recesses 130 and 132 formed in the base portion 134 of the excavation tooth 10. Upon securing the excavation tooth 10 to the nose piece 12 of adaptor 11 by flex pin 14, the stabilizing ribs 126 and 128 are held within recesses 130 and 132, preventing any lateral movement of the wear cap 15 with respect to the tooth 10 and adaptor 11, while axial movement of wear cap 15 prevented by securement rib 110.

By way of example, wear cap 15 defines an overall length of 8.62 in., a width of 8.25 in., and a height of 4.52 in. The tooth abutment surface 82 and the leading edges 126' and 128' of stabilizing ribs 126 and 128 define an angle of about 70° with respect the bottom surface 88 of leg portion 84. Rounded shoulders 96 defines a radius of curvature of 0.28 in., shoulder 98 a radius of curvature of 0.312 in., shoulder 100 a radius of curvature 0.56 in. and shoulder 102 a radius of curvature of 0.34 in. Shoulders 112 and 114 and 118 defined by securement rib 110 define a radii of curvature of 0.34 in., shoulder 116 a radius of curvature of 0.56 in. and concave upper surface 120 a radius of curvature of 5.0 in. Inclined surface 106 of adaptor 11 which abuts lower surface 88 of leg portion 84 of the wear cap 15 and is parallel thereto defines an angle of 27° 15' with respect to the horizontal.

To attach the excavation tooth 10 to the adaptor 11, it is only necessary to slide the wear cap 15 transversely onto the adaptor 11 about securement rib 110 such that lower surfaces 88 and 90 of the wear cap 15 abut surfaces 106 and 108 of adaptor 11, whereupon the wear cap is restrained from any axial or vertical movement by securement rib 110 and is thus prevented from sliding forwardly down the nose piece 12. The excavation tooth 10 is then placed over the tapered extension 20 of the nose piece such that orifices 46 and 48 therein register with the vertical channel 32 in the nose piece and recesses 130 and 132 in the base portion 134 of tooth 10 are disposed about the stabilizing ribs 126 and 128 on the forward surface 82 of wear cap 15. Flex pin 14 is then inserted through orifice 4 in the excavation tooth 10 with the flex pin oriented such that the first elongate member 58 is pointed toward the forward working end of tooth 10 . Flex pin 14 is then forced into vertical channel 32. When flex pin 14 is fully inserted into channel 32, as shown in FIG. 2, shoulder 72 engages the nose piece 12 at shoulder 50, limiting further insertion. At this point, shoulder 78 of the second elongate member 60 moves past tooth 10, allowing the rubber center 62 to expand, thereby forcing shoulder 78 outward such that it would abut tooth 10 at shoulder 54 if withdrawal of the flex pin were attempted. A similar result occurs with shoulder 74, 76, 52 and 56. The flex pin 14 is thusly retained in channel 32.

The abutting relationship of the vertical stabilizing wall 30 on the nose piece surrounding recessed area 28 with the perimeter wall 44 of the protuberance 40 on the interior of tooth 10 extending into recessed area 28 prevents lateral movement of the tooth with respect to the nose piece during use which would otherwise cause undesirable wear on the respective parts. Similarly, the abutting relationship of the horizontal lower surface 44 of the protuberance 40 on the tooth 10 with the flat horizontal stabilizing surface 29 on the nose piece prevents vertical rotational movement of the tooth with respect to the nose piece which would also result in wear. Just as the tooth 10 is prevented from moving with respect to the nose piece 12 on which it is mounted, the wear cap 15 is prevented from undergoing relative movement with respect to the adaptor 11 and tooth 10 by means of the interlocking engagements of the wear cap to the adaptor and tooth by means of the interlocking configurations of the transverse securement rib 110 within the correspondingly configured channel 92 in the wear cap 15 and the forward stabilizing ribs 126 and 128 on the wear cap within recesses 130 and 132 in the base portion 134 of excavation tooth 10.

Figure 7:
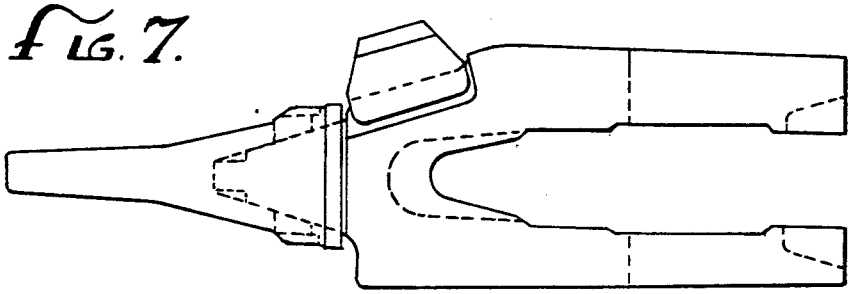
FIG. 7 is a partial sectional view of the prior art employing an axially mounted wear cap.

In the prior art devices illustrated in FIG. 7, the wear cap 15' was mounted on a longitudinally disposed dovetailed rib 110' on the tapered nose piece which, while preventing lateral movement, allowed the wear cap 15' to slide freely down the tapered nose piece when the excavation tooth was not secured thereon. Accordingly, the task of tooth replacement was made more laborious by the need to continually hold the wear cap in place during the process.

In use, as the excavation tooth impacts the earth, the base portion 134 of tooth 10 is pressed against the forward surface 82 of wear cap 15 allowing the wear cap 15 to absorb the resultant force and any wear resulting therefrom, thereby preventing damage and wear to the adaptor 11 which, without the use of wear cap 15, would sustain such wear and require far more frequent replacement than would be required with the use of wear cap 15. As the excavation teeth become worn from use, they can be easily replaced as above described. Similarly, when the wear caps becomes worn through the continual stress imparted thereon by the base portions of the teeth, the wear caps can also be easily replaced, while the useful life of the heavier, more costly and difficult to replace adaptor is increased.

Various changes and modifications may be made in carrying out the present invention without departing from the spirit and scope thereof. Insofar as those changes and modifications are within the purview of the appended claims, they are to be considered as part of the present invention.

We claim:

1. In an attachment assembly for securing an excavation tooth on an earth excavation device of the type including an adaptor having a tapered nose piece at one end thereof for carrying the tooth and defining means rearwardly of the nose piece for securing the adaptor to the excavation device, the improvement comprising a wear cap adapted to be carried by and engage the adaptor so as to abut a rear portion of the tooth for reducing wear of the adaptor during use, said wear cap defining:

a forward tooth abutment surface;

a first inclined lower surface adapted to abut a first portion of the adaptor rearwardly of the nose piece;

a second inclined lower surface spaced from said first inclined lower surface and adapted to abut a second portion of the adaptor;

an open channel disposed between said first and second inclined surfaces and extending transversely through said wear cap, said channel defining a continuously curvilinear transverse wall within said wear cap and being adapted to receive a third portion of the adaptor therein such that upon transversely sliding said wear cap over the third portion of the adaptor such that said third portion is received within said channel, said first and second inclined lower surfaces abut the first and second portions of the adaptor and said forward abutment surface is disposed substantially normal to the tooth; and means defined by said forward tooth abutment surface for engaging a portion of the tooth to prevent latter relative movement therebetween.

2. The improvement of claim 1 wherein portions of said curvilinear transverse wall extend outwardly from said first and second inclined lower surfaces on said wear cap to provide said channel with a narrowed opening adjacent said first and second inclined lower surfaces for retaining said wear cap on the third portion of the adaptor.

3. The improvement of claim 1 wherein said curvilinear transverse wall defines a first channel side wall portion extending from said first inclined lower surface of said wear cap, a second oppositely disposed channel side wall portion extending from said second inclined lower surface of said wear cap and a channel bottom wall portion extending therebetween, the distance between said channel bottom wall portion adjacent said first side wall portion to said first inclined lower surface being greater than the distance between said channel bottom wall portion adjacent said second side wall portion to said second inclined lower surface.

4. The improvements of claims 1, 2 or 3 wherein said engaging means on said forward tooth abutment surface comprises a plurality of vertical elongated stabilizing ribs, said ribs being integrally formed with said wear cap and substantially semicylindrical in cross-section.

5. In an attachment assembly for securing an excavation tooth on an earth excavation device of the type including an adaptor having a tapered nose piece at one end thereof for carrying the tooth and defining means rearwardly of the nose piece for securing the adaptor to the excavation device, the improvement comprising a wear cap adapted to be carried by and engage the adaptor so as to abut a rear portion of the tooth for reducing wear of the adaptor during use, said wear cap defining:

a pair of depending leg portions terminating in first and second lower inclined surfaces adapted to abut first and second portions of the adaptor rearwardly of the nose piece;

a forward tooth abutment surface, said surface defining means thereon adapted to engage a portion of the tooth to prevent lateral relative movement therebetween; and an opened channel disposed between said first and second leg portions and extending transversely through said wear cap, said channel defining a continuously curvilinear transverse wall within said wear cap and being adapted to receive a third portion of the adaptor therein such that upon transversely sliding said wear cap over the third portion of the adaptor such that said third portion is received within said channel, said first and second inclined lower surfaces abut the first and second portions of the adaptor and said forward abutment surface is disposed substantially normal to the tooth.

6. The improvement of claim 5 wherein said engaging means defined by said forward tooth abutment surface of said wear cap comprises a plurality of vertical elongated stabilizing ribs integrally formed with said wear cap and being substantially semicylindrical in cross-section.

7. The improvements of claims 5 or 6 wherein said forward tooth abutment surface defines an outer surface of said first leg portion of said wear cap and the length of said first leg portion is greater than the length of said second leg portion.

8. An attachment assembly for securing an excavation tooth on an earth excavation device comprising:

an excavation tooth;

an adaptor defining a tapered nose piece at one end thereof for carrying said tooth and defining means rearwardly of said nose piece for securing the adaptor to the excavation device; and a wear cap adapted to be carried by and engage the adaptor so as to abut a rear portion of said tooth for reducing wear of the adaptor during use, said wear cap defining a forward tooth abutment surface, a first inclined lower surface adapted to abut a first portion of said adaptor rearwardly of said nose piece, a second inclined lower surface spaced from said first inclined lower surface and adapted to abut a second portion of said adaptor, an open channel disposed between said first and second inclined surfaces and extending transversely through said wear cap, said channel defining a continuous curvilinear transverse wall within said wear cap and being adapted to receive a third portion of said adaptor therein such that upon transversely sliding said wear cap over said third portion of said adaptor such that said third portion is received within said channel, said first and second inclined lower surfaces abut said first and second portions of said adaptor and said forward abutment surface is disposed substantially normal to said tooth, and means defined by said forward tooth abutment surface for engaging a portion of said tooth to prevent lateral movement therebetween.

9. The assembly of claim 8 wherein portions of said curvilinear transverse wall extend outwardly from said first and second inclined lower surfaces on said wear cap to provide said channel with a narrowed opening adjacent said first and second inclined lower surfaces for retaining said wear cap on said third portion of said adaptor.

10. The assembly of claim 8 wherein said curvilinear wall defines a first channel side wall portion extending from said first inclined lower surface of said wear cap, a second oppositely disposed channel side wall portion extending from said second inclined lower surface of said wear cap and a channel bottom wall portion extending therebetween, the distance between said channel bottom wall portion adjacent said first side wall portion to said first inclined lower surface being greater than the distance between said channel bottom wall portion adjacent said second side wall portion to said second inclined lower surface.

11. The assembly of claims 8, 9 or 10 wherein said engaging means on said forward tooth abutment surface comprises a plurality of vertical elongated stabilizing ribs, said ribs being integrally formed with said wear cap and substantially semicylindrical in cross-section.

* * * * *